United States Patent [19]

Kawabata et al.

[11] 4,391,246

[45] Jul. 5, 1983

[54] THROTTLE OPENER DEVICE FOR VEHICLE ENGINES

[75] Inventors: Etsuo Kawabata, Wakoh; Masahiko Ogura, Sakado; Akinobu Takagi, Yokohama; Akira Fujimura, Niiza, all of Japan

[73] Assignee: Honda Giken Kogyo Kabushiki Kaisha, Tokyo, Japan

[21] Appl. No.: 385,488

[22] Filed: Jun. 7, 1982

Related U.S. Application Data

[63] Continuation of Ser. No. 144,325, Apr. 28, 1980, abandoned.

[30] Foreign Application Priority Data

May 7, 1979 [JP] Japan ..... 54-54705
Nov. 20, 1979 [JP] Japan ..... 54-151264

[51] Int. Cl.[3] ..... F02S 11/10; F02D 1/04; F02M 19/12

[52] U.S. Cl. ..... 123/391; 123/328; 123/378; 123/376; 123/340; 74/866; 123/341

[58] Field of Search ..... 123/328, 378, 376, 340, 123/341, 391; 74/866, 752 A, 860

[56] References Cited

U.S. PATENT DOCUMENTS

| | | | |
|---|---|---|---|
| 2,397,835 | 4/1946 | Brame | 123/391 |
| 2,491,497 | 12/1949 | Jorgenson et al. | 123/391 |
| 2,669,982 | 2/1954 | Schowarter et al. | 123/391 |
| 3,092,090 | 6/1963 | Berninger | 123/391 |
| 3,371,674 | 3/1968 | Thorner | 123/378 |
| 3,603,297 | 9/1971 | Sherwin | 123/328 |
| 3,621,824 | 11/1971 | Burnia et al. | 123/328 |
| 3,691,873 | 9/1972 | Lombard et al. | 123/328 |
| 3,964,457 | 6/1976 | Coscia | 123/340 |

FOREIGN PATENT DOCUMENTS

| | | | |
|---|---|---|---|
| 2228653 | 2/1973 | Fed. Rep. of Germany | 123/328 |
| 55-51934 | 4/1980 | Japan | 123/328 |
| 1214072 | 12/1970 | United Kingdom | 123/328 |

*Primary Examiner*—Raymond A. Nelli
*Attorney, Agent, or Firm*—Lyon & Lyon

[57] ABSTRACT

A throttle valve opener for a throttle valve in the intake passage of a vehicle engine is actuated by suction pressure from the intake passage, the suction pressure being weakened by introduction of atmospheric air during certain operating conditions of the engine. Suction pressure for operating the throttle valve opener is cut off when the vehicle speed or the engine RPM exceed predetermined values, or when the engine's cooling water temperature rises above a predetermined limit. This system controls deceleration of the engine to reduce exhaust pollutants without adverse effects on the drivability of the vehicle.

7 Claims, 3 Drawing Figures

10
11
12
13
14
15
16
17
18
19
21
22
23
24
25
26
27
28
29
31
32
33
34
35
36
37
38
39
40
41
42
43
44
48
50

THROTTLE OPENER DEVICE FOR VEHICLE ENGINES

This is a continuation of application Ser. No. 144,325 filed Apr. 28, 1980, now abandoned.

This invention relates to a throttle valve control device for an internal combustion engine for a vehicle. The device is capable of maintaining the throttle valve in slightly open position during deceleration of the vehicle.

In conventionally known internal combustion engines for vehicles such as automobiles or the like, the throttle valve during deceleration usually has its opening maintained at a value slightly larger than the idle opening by the action of a throttle opener, in order to reduce emissions of unburned gases into the atmosphere. Such emissions are caused by decrease of the mixture charging efficiency of the internal combustion engine during deceleration of the engine. Also, it is often necessary to provide an exhaust gas purifying apparatus, particularly a catalytic converter, in the exhaust passage of the engine in view of the legal regulations concerning noxious components in the exhaust gas. However, since such catalytic converter is usually located under the vehicle floor because of limited space in the vehicle, some measures should be provided for prevention of damage to the vehicle floor by burning due to the reaction heat of the catalytic converter. In order to satisfy this requirement, a throttle opener is provided for operation during deceleration of the engine to increase the combustion efficiency of the intake mixture in the engine, and thereby lighten the burden of the catalytic converter. This also contributes to the prevention of burning of the vehicle floor. However, this measure has drawbacks in that the engine brake effect may decrease, which in turn may degrade the drivability and the fuel economy.

An important object of the present invention is to provide a simple and useful throttle valve control device which can eliminate the above-mentioned drawbacks.

Other objects and advantages will appear hereinafter.

Figure 1:
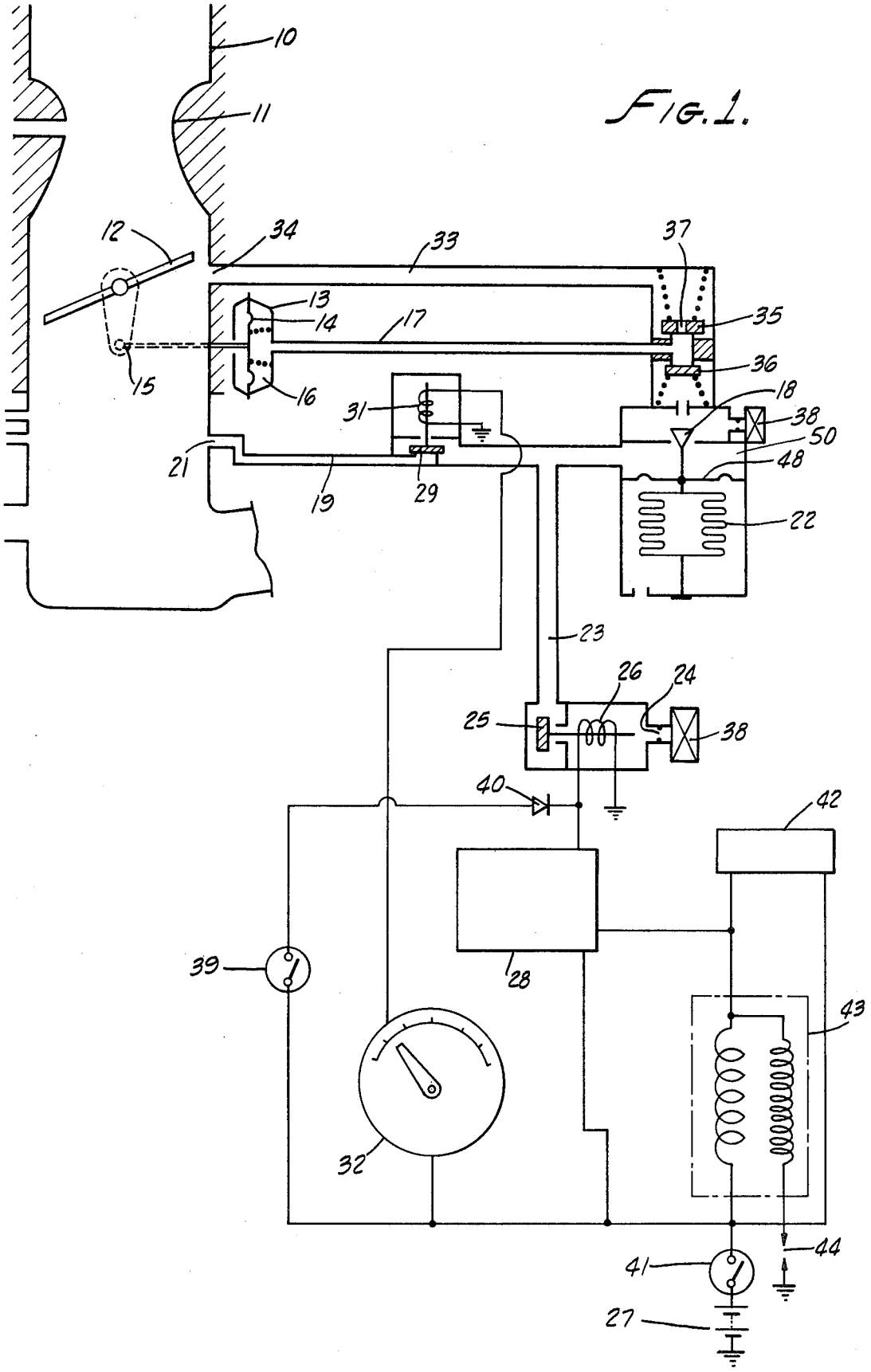
FIG. 1 is a schematic drawing showing a preferred embodiment of this invention.

Referring to the drawings, the internal combustion engine is provided with an air intake passage 10, a carburetor 11, and a throttle valve 12 provided in the carburetor. A throttle opener device generally designated 13 is provided with a flexible diaphragm 14 connected by mechanical linkage 15 to the throttle valve 12. The diaphragm 14 forms one wall of a suction chamber 16 which communicates through passage 17 and a second check valve 36 with the control valve generally designated 18. The control valve 18 communicates through passage 19 with the suction port 21 downstream of the throttle valve 12. The control valve 18 opens in response to high vacuum pressure produced on deceleration of the engine, to actuate the throttle opener device 13 and thereby maintain the position of the throttle valve 12 for an opening slightly larger than the idle position.

The control valve 18 is adapted to open when the suction pressure in a vacuum chamber 50 of the valve 18 increases over a predetermined vacuum intensity so that its diaphragm 48 is displaced. The control valve 18 has a rear bellows 22 for atmospheric pressure compensation. Within the rear bellows 22 is a spring which pulls the valve 18 toward a closed direction.

In accordance with the present invention, a passage 23 communicates with the suction pressure passage 19 at a location upstream of the control valve 18 to communicate the latter passage with the atmosphere by way of a restriction 24. The passage 23 is provided with a first valve 25 which is normally open, and is closed only when the engine operates at a high rotational speed. As a result, since the valve 25 opens when the engine operates at a low rotational speed, the suction pressure passage 19 is supplied with atmospheric air through the restriction 24 by way of the valve 25 so that the throttle opener 13 remains inoperative even when the engine is subjected to a further deceleration. On the other hand, since the valve 25 is closed when the engine operates at a high rotational speed, the suction pressure passage 19 is not under the influence of the atmospheric pressure, and, accordingly, a further deceleration of the engine causes the throttle opener 13 to operate in response to the suction pressure.

More specifically, when the engine operates at a low rotational speed, for example, below 3,000 RPM, and is decelerated, any actuation of the throttle opener 13 would cause the driver of the vehicle to feel uneasy about stopping of the vehicle since the engine does not slow down exactly as expected. However, in such case, according to the present invention, the throttle opener 13 remains inoperative so that the throttle valve 3 moves to the idle position, thus resulting in an improvement in the drivability.

On the other hand, when the engine is operating at a high rotational speed, for example, about 3,000 RPM, and is decelerated, the throttle opener 13 is actuated to ensure good combustion and thereby obtain an improvement in noxious emissions in the exhaust, according to the present invention.

The first normally-open valve 25 mentioned above comprises an electromagnetic valve which is closed when its solenoid 26 is energized. There is provided a circuit which connects the solenoid 26 to a power source 27, and in this circuit is provided a sensor 28 comprising a switch for detecting the number of revolutions of the engine which is adapted to be closed when the engine is operated at a speed above 3,000 RPM.

In the illustrated embodiment, a second valve 29 is also provided which is normally closed and which is adapted to open only when the vehicle runs at a high speed, the valve being located upstream of the control valve 18 in the suction pressure passage 19. With this arrangement, when the vehicle speed is high, the second valve 29 opens to allow suction pressure to be applied to the throttle opener 13 to actuate the same. When the vehicle speed is low, the valve 29 is closed so that no suction pressure is applied therethrough to the throttle opener 13. In principle, this kind of throttle opener system decreases the engine braking effect to some extent. However, in fact it is an essential requisite that the vehicle should slow down exactly as expected. To fulfill this requisite, according to the invention, the throttle opener 13 is not actuated when the vehicle runs at a low speed, for example, below 20 km/h, to thereby ensure improved drivability.

The second normally-closed valve 29 may comprise, for example, an electromagnetic valve which is adapted to open when its solenoid 31 is energized. There is provided a circuit which connects the solenoid 31 to the power source 27, and in this circuit a switching sensor 32 is arranged which is adapted to open when the vehicle speed is below 20 km/h.

Furthermore, the throttle opener 13 is also adapted to function as a dash pot for damping its closing movement to reduce the closing speed thereof. For this purpose, a branch passage 33 communicates with the passage 17 and is connected to a second suction pressure intake port 34 which is so located as to open in a zone slightly upstream of the throttle valve 12 when the latter is in its closed position. The branch passage 33 is provided, at its branched portion, with a first check valve 35.

The first check valve 35 has a restriction 37 for controlling the closing speed of the throttle valve 12. A filter 38 is arranged over an open end of the passage 23.

The operation of the throttle opener will now be described. Since the first normally open valve 25 opens at a low rotational speed of the engine, the suction pressure passage 19 is supplied with atmospheric pressure through the restriction 24 by way of the first valve 25, so that the throttle opener 13 is not subject to the suction pressure and is maintained at its non-operative position when the engine is subsequently decelerated. Thus, the throttle valve 12 can keep its idling opening to cause the vehicle to stop at any expected position without giving an uneasy feeling to the driver, resulting in an improved drivability.

When the engine operates at a high rotational speed, the first normally open valve 25 is closed to keep the atmospheric pressure from being introduced into the negative pressure passage 17. As a result, the throttle opener 13 is actuated by the suction pressure in response to slowing of the speed of the engine. Thus, good combustion can take place to obtain a decrease in the amount of discharged unburned gas, leading to an improvement in noxious emissions in the exhaust.

As described above, the throttle opener 13 is adapted to become operative and inoperative in accordance with slowing of the engine at a high rotational speed and at a low rotational speed, respectively, to thereby obtain an improvement in noxious emission in the exhaust, as well as an improvement in the drivability.

The transistor controlled ignition circuit 42, energized by the ignition switch 41, receives an input signal of ignition timing from a distributor; it creates an output signal of ignition timing to control direct current applied to the ignition coil 43 and a high voltage discharge through the spark plug 44.

The electric switch 39 receives a signal from a thermal switch placed in a cooling water passage in the cylinder head or cylinder block of the engine. The electric switch 39 is closed when the temperature of the engine cooling water is below 75° C., and the solenoid 26 is energized to close the first valve 25. The switch 39 is connected to the solenoid 26 through the diode 40.

Figure 2:
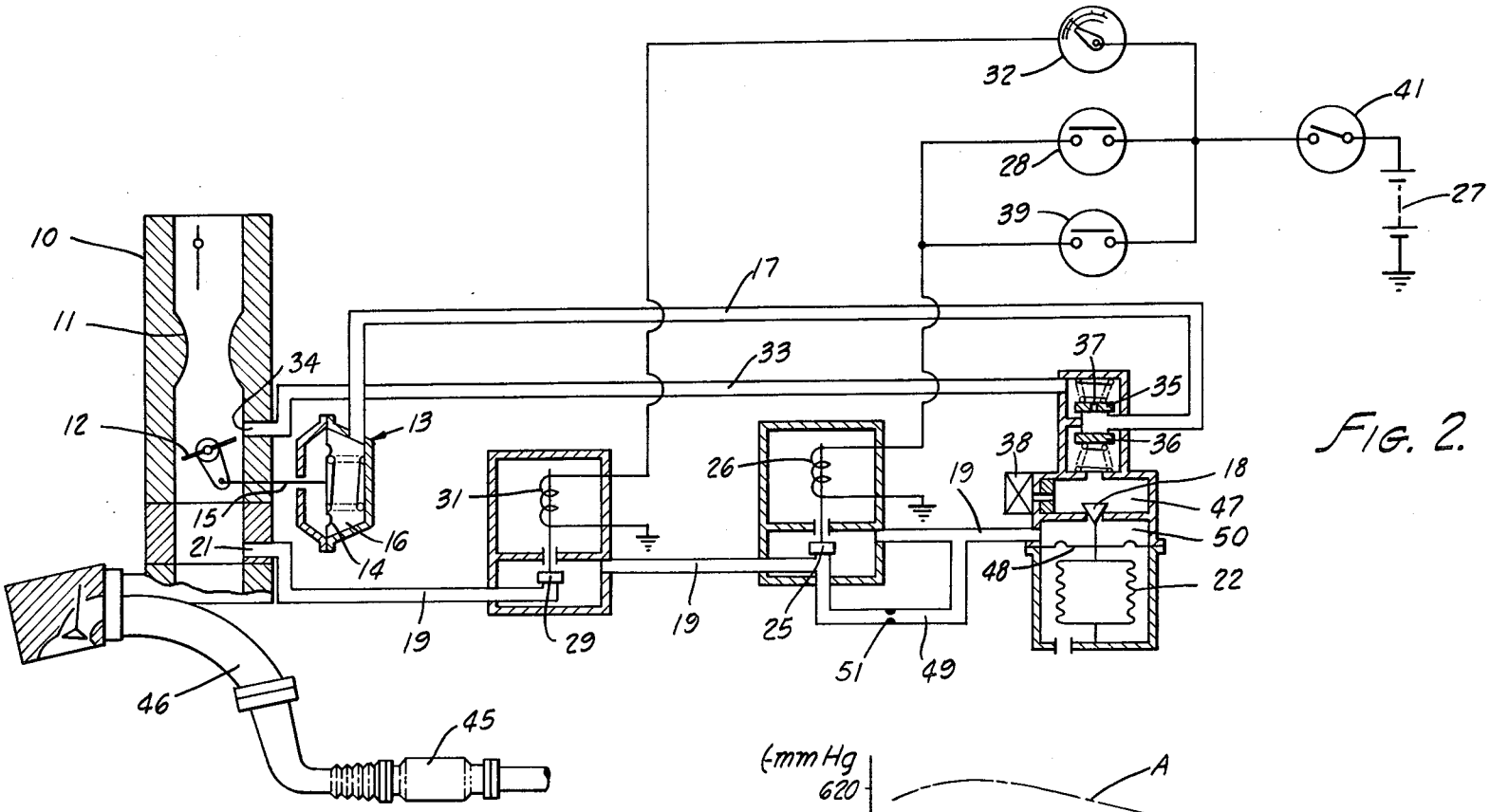
FIG. 2 is a similar drawing showing a modification.

In the modified form of the invention shown in FIG. 2, parts which are similar to those in FIG. 1 are indicated by the same number. The catalytic converter 45 receives exhaust gases from the engine exhaust pipe 46.

Assuming that the engine has a very high temperature and accordingly the switch 39 is off, the first electromagnetic valve 29 is energized by the vehicle speed sensing switch 32 and open when the vehicle runs at a high speed. When the accelerator pedal of the vehicle is released to decelerate the vehicle, the throttle valve 12 is actuated by the force of a spring (not shown) into a closed position from a fully open position, for instance. On this occasion, when the opening then assumed by the throttle valve 12 is substantial, so that little suction pressure is produced near the port 34, the throttle valve 12 draws the diaphragm 14 of the throttle opener 13 through the actuating rod 15 so that the pressure in the vacuum chamber 16 in which atmospheric pressure has been prevailing is decreased. As a result, the air in the intake passage 10 is sucked into the vacuum chamber 16, via the port 34, the conduit 33, the orifice 37 of the one-way valve 35 and the suction pressure passage 17. The flow rate of the sucked air is however limited to a constant value by the flow resistance of the orifice 37. Thus, the throttle opener 13 serves as a dash pot to damp the closing motion of the throttle valve 12.

As the throttle valve 12 has its opening further decreased so that the outer edge of the throttle valve approaches the port 34, suction pressure is produced to act on the port 34 to cause the one-way valve 35 to open. Consequently, the suction pressure is transmitted to vacuum chamber 16 via the suction pressure passage 17 to further damp the closing motion of the throttle valve 12. During this decelerating operation, if the engine is then operated at a rotational speed above a predetermined value, the first electromagnetic valve 25 is energized by the engine speed sensing switch 28 to move into an open position. The second electromagnetic valve 29 is then open as mentioned above. Thus, the suction pressure-actuated valve 18 is allowed to communicate with the port 21 through passage 19 thus opened. As a result, a suction pressure is produced in a zone downstream of the throttle valve 12, i.e. the intake suction pressure acts on the port 21 so that the resulting suction pressure signal is transmitted to the input suction pressure chamber 50 of the valve 18 by way of the passage 19. When the intake suction pressure reaches a predetermined value at which the valve 18 can be actuated, by a further decrease in the opening of the throttle valve 12, the diaphragm 48 is displaced to open the valve 18 and then open the one-way valve 36. The suction pressure is then introduced into the vacuum chamber 16 of the throttle opener 13 by way of the passage 17 to actuate the throttle opener 13, thus maintaining the opening of throttle valve 12 at a predetermined small value.

On the other hand, when the engine rotational speed is within a low speed range below a predetermined value, the first electromagnetic valve 25 is de-energized by the engine speed switch 28 into a closed position. As a consequence, due to the presence of the restriction 51 in the side passage 49 in the line between port 21 and the input vacuum chamber 50 of the suction pressure-actuated valve 18, the transmission speed of the intake suction pressure signal to the input vacuum chamber 50 is delayed by the suction pressure delaying function of the restriction 51 in the side passage 49. As a result, the intake suction pressure is already more intense than the suction pressure value corresponding to the above-mentioned engine rotational speed before the suction pressure in the chamber 50 reaches the predetermined actuating value for the suction pressure actuated valve 18 to actuate the throttle opener 13. Therefore, a good engine braking effect can be obtained and the fuel consumption can be kept at a small value in this middle and low engine speed range.

Figure 3:
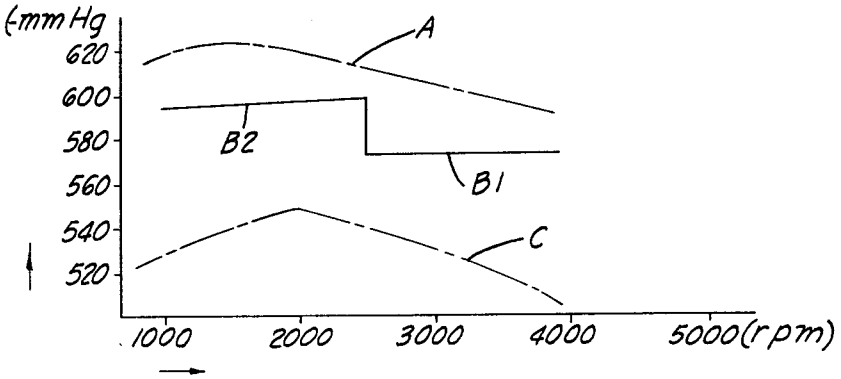
FIG. 3 is a graph showing the relationship between intake vacuum pressure compared to engine RPM.

FIG. 3 shows the characteristic curves B1 and B2 of the intake suction pressure with respect to different operative states of the engine for either form of the invention illustrated. That is, the line B1 shows the suction pressure produced in a high rotational speed range of the engine, and the line B2 shows the suction pressure produced in a middle or low rotational speed range of the engine. The line A indicates the characteristic curve of an intake suction pressure required for limiting the reaction temperature of the catalytic converter 45 to an upper limit (e.g. 900° C.). The line C indicates the characteristic curve of the intake suction pressure produced during the no-load operation of the engine. As can be understood from FIG. 3, the intake suction pressure curves B1 and B2 which are controlled by the action of the throttle opener 13 are close to the required characteristic curve A, which means that the catalyst of the catalytic converter 45 can be kept in a good active state without overheating.

When the vehicle is further decelerated into a low running speed range, the second electromagnetic valve 29 is de-energized by the speed sensing switch 32 into its closed position to close the suction pressure passage 19, so that the throttle opener 13 allows the throttle valve 12 to have its opening reduced to its idling opening, thus enhancing the engine braking effect.

When the engine is in a low temperature state, the temperature sensing switch 39 turns on to energize the first electromagnetic valve 25, to maintain it in open position, irrespective of the rotational speed of the engine, thus rendering inoperative the side passage 49.

As stated above, according to the present invention, there is provided a control device comprising a suction pressure-actuated valve adapted to open in response to an input suction pressure above a predetermined value. The valve is arranged in a suction pressure passage connecting a vacuum chamber defined in a throttle opener coupled to a throttle valve. A suction pressure sensing port is located downstream of the throttle valve in the intake passage of the engine. A control valve adapted to open in response to the operative state of the engine is arranged at a location upstream of the suction pressure-actuated valve in the suction pressure passage. A side passage is also provided in a fashion bypassing the control valve to serve to delay the transmission of suction pressure to the suction pressure-actuated valve. With this arrangement, when the engine is decelerated, the time at which the throttle opener is actuated is controlled in accordance with the operative state of the engine, thereby enduring good drivability as well as reducing emissions of unburned components in the exhaust gas while also ensuring good engine braking effect. Furthermore, it is also possible to lighten the burden of the exhaust gas purifier optionally provided in the exhaust passage as well as prevent overheating thereof.

Having fully described our invention, it is to be understood that we are not to be limited to the details herein set forth but that our invention is of the full scope of the appended claims.

We claim:

1. For use with an internal combustion engine for driving a vehicle, the engine having an intake passage provided with a throttle valve and a throttle valve opener, the improvement comprising, in combination: a suction passage connecting said throttle valve opener with a vacuum port on the intake passage downstream from said throttle valve, a vacuum responsive throttle opener control valve in said suction passage which transmits a controlled vacuum pressure into said throttle valve opener when the vehicle speed is above a predetermined speed, vacuum pressure regulating means positioned in said suction passage between said vacuum port and said throttle opener control valve, said vacuum pressure regulating means including restriction means and including atmospheric intake valve means, said vacuum pressure regulating means acting to reduce vacuum pressure transmitted from said vacuum port to said throttle opener control valve in response to an operative state of the engine.

2. The combination set forth in claim 1 in which said operative state of the engine is low speed of the engine.

3. The combination set forth in claim 1 in which said operative state of the engine is high temperature of the engine.

4. For use with an internal combustion engine for driving a vehicle, the engine having an intake passage provided with a throttle valve and a throttle valve opener, the improvement comprising, in combination: a suction passage connecting said throttle valve opener with a vacuum port on the intake passage downstream from said throttle valve, a vacuum responsive throttle opener control valve in said suction passage which transmits a controlled vacuum pressure into said throttle valve opener when the vehicle speed is above a predetermined speed, vacuum pressure regulating means positioned in said suction passage between said vacuum port and said throttle opener control valve, said vacuum pressure regulating means including restriction means in said suction passage, said vacuum pressure regulating means acting to reduce vacuum pressure transmitted from said vacuum port to said throttle opener control valve in response to an operative state of the engine.

5. The combination set forth in claim 4 in which said operation state of the engine is high temperature of the engine.

6. The combination set forth in claim 4 in which said vacuum pressure regulating means are atmospheric intake valve means including restriction means which introduce atmospheric air into said suction passage.

7. The combination set forth in claim 4 in which said operative state of the engine is low speed of the engine.

* * * * *